US005269329A

United States Patent [19]

Geer et al.

[11] Patent Number: 5,269,329

[45] Date of Patent: * Dec. 14, 1993

[54] METHOD OF PRODUCING TOBACCO FLAVORED CIGARETTE FILTER

[75] Inventors: Robert G. Geer, Canton; Thomas L. Fillio, Roswell; Loyd G. Kasbo, Norcross, all of Ga.

[73] Assignee: Kimberly-Clark Corporation, Neenah, Wis.

[ * ] Notice: The portion of the term of this patent subsequent to Oct. 9, 2007 has been disclaimed.

[21] Appl. No.: 549,868

[22] Filed: Jul. 9, 1990

[51] Int. Cl.[5] ..... A24F 3/00; A24F 3/02

[52] U.S. Cl. ..... 131/332; 131/297; 131/335

[58] Field of Search ..... 131/297, 332, 361

[56] References Cited

U.S. PATENT DOCUMENTS

| | | | |
|---|---|---|---|
| 1,374,466 | 4/1921 | Pappanikolaou . | |
| 1,605,059 | 1/1926 | Oakes et al. . | |
| 3,068,873 | 11/1958 | Allman, Jr. et al. . | |
| 3,144,024 | 8/1964 | Eichwald et al. | 131/335 X |
| 3,880,173 | 4/1975 | Hill | 131/269 |
| 4,189,511 | 2/1980 | Levers et al. . | |
| 4,279,848 | 7/1981 | Baxter et al. . | |
| 4,291,711 | 9/1981 | Berger . | |
| 4,350,173 | 9/1982 | Siren | 131/332 |
| 4,466,451 | 8/1984 | Bonnet et al. | 131/335 |
| 4,546,040 | 10/1985 | Knotek et al. . | |
| 4,704,481 | 11/1987 | Alper et al. | 568/658 |
| 4,729,391 | 3/1988 | Woods et al. | 131/332 |
| 4,811,745 | 3/1989 | Cohen et al. | 131/342 |
| 4,961,415 | 10/1990 | Radwanski et al. | 131/332 |
| 5,060,669 | 10/1991 | White et al. | 131/297 |
| 5,099,862 | 3/1992 | White et al. | 131/297 |

FOREIGN PATENT DOCUMENTS

| | | |
|---|---|---|
| 1210659 | 9/1986 | Canada . |
| 0069056 | 1/1982 | European Pat. Off. . |
| 0330709 | 1/1988 | European Pat. Off. . |
| 0271036 | 6/1988 | European Pat. Off. . |
| 0295518 | 12/1988 | European Pat. Off. . |
| 0434332A2 | 12/1990 | European Pat. Off. . |
| 2004729 | 4/1979 | United Kingdom . |
| 1570121 | 6/1980 | United Kingdom . |
| 2201879 | 9/1988 | United Kingdom . |

*Primary Examiner*—V. Millin
*Assistant Examiner*—J. Doyle
*Attorney, Agent, or Firm*—William D. Herrick

[57] ABSTRACT

There is disclosed a method of adding flavorant to cigarette filters. A cigarette filter is made by forming a filter web using non-woven web comprising thermoplastic meltblown fibers of filaments that are present as fused agglomerates in a number fraction exceeding 33 percent and wherein a majority of fiber crossings of agglomerates are weld points; adding tobacco extracts to the filter web such that the filter web contains between 10% and 110% tobacco extracts by weight of the filter web; adding glycerin or a glycerin-water mixture to the thus treated filter web; and forming the thus treated filter web into a rod.

8 Claims, 1 Drawing Sheet

METHOD OF PRODUCING TOBACCO FLAVORED CIGARETTE FILTER

FIELD OF INVENTION

The invention relates to a method for adding tobacco extracts to a filter for use with smoking products. More particularly, this invention relates to a method for producing cigarette filters having tobacco extracts in amounts of between 10% and 110% by weight of the filter material.

BACKGROUND OF THE INVENTION

The combustion of tobacco produces an aerosol containing gasses and particulate matter, such as tar and nicotine, suspended within the gasses. It is common for cigarette manufacturers to attach filters to tobacco cigarettes or rods to remove tar and nicotine from the aerosol in order to reduce the smoker's exposure to these particles. However, in addition to removing tar and nicotine, filters also remove components of the aerosol which provide tobacco flavor or taste to the smoker.

Various attempts have been made in the prior art to incorporate tobacco extracts and other flavorants in the filter portion of cigarettes to provide enhanced flavor to the smoke while still reducing tar and nicotine. One such example is Woods et al. U.S. Pat. No. 4,729,391. The Woods et al. patent describes a filter construction comprising a conventional cellulose acetate filter tow wrapped with a sheet of microporous polymer, such as polypropylene, having flavorant in amounts of between 0.01% to 6.0% by weight of the filter material adsorbed thereon for release into the smoke stream during smoking of the cigarette.

It is also known in the art to add flavorants to conventional paper and cellulose acetate filters in amounts up to about 10% by weight of the filter material. Such filters are most commonly treated with flavorants in amounts of between 0.1% and 1.0% by weight of the filter material. The addition of flavorants in higher amounts is considered wasteful because most of the flavorant is absorbed into the fibers of the filter material and does not contribute to flavor.

In addition, the conventional tow structure of such filters, in which the filter material is aligned in parallel strips, limits the amount of flavorant that may be added. The orientation of the fibers provides a limited number of interstices in which to trap the flavorant. Thus, even tow filters made of polypropylene, a hydrophobic material which does not absorb flavorants, do not provide much of an advantage over paper or cellulose acetate tow filters due to the limited surface area available to hold flavorants.

Another consideration in producing cigarette filters is the necessity of being able to form the filter material into a rod at commercially acceptable speeds. Conventional rod making machines are not able to form continuous filter material containing tobacco extract in excess of about 10% by weight of the materials into rods, because the tobacco extract builds up on the tongue of conventional rod making machines and thus requires frequent stoppage of the machines to remove the buildup.

Radwanski et al. U.S. patent applicaion, Ser. No. 003,980, filed Jan. 16, 1987, now U.S. Pat. No. 4,961,415 discloses a polypropylene filter web suitable for use as a cigarette filter. Filters produced in accordance with the disclosure of that patent application have a larger number of interstices than conventional tow construction filters. However, industry practice does not suggest that it would be possible or beneficial to add tobacco extracts to such filters in amounts exceeding 10% of the weight of the filter web. Moreover, even if it was beneficial or possible to add tobacco extracts in amounts exceeding 10% by weight, commercial practice suggests that such filters could not be produced at commercially acceptable speeds.

Therefore, a need exists for a cigarette filter and a commerically acceptable method of producing a cigarette filter which offers improved taste characteristics by providing a filter containing tobacco extract in excess of 10% by weight of the filter material.

SUMMARY OF THE INVENTION

The present invention solves the above-described need by providing a cigarette filter and a commercially acceptable method of producing a cigarette filter which offers improved taste characteristics by providing a filter containing tobacco extract in excess of 10% by weight of the filter material.

Generally, the method of this invention comprises the steps of forming a filter from a non-woven web comprising thermoplastic melt-blown fibers or filaments that are present as fused agglomerates in a number fraction exceeding 33% and wherein a majority of fiber crossings of agglomerates are weld points; adding at least one flavorant to the filter such that the finished filter contains flavorant in an amount which is at least 10% by weight of the filter web; adding a lubricant to the web; and forming the web into a shaped filter rod.

The preferred method of this invention comprises the steps of forming a filter from a non-woven web comprising thermoplastic melt-blown fibers or filaments that are present as fused agglomerates in a number fraction exceeding 33% and wherein a majority of fiber crossings of agglomerates are weld points; adding a 10% to 40% by weight of tobacco extract in a water solution to the filter web; drying the thus treated filter web to form a filter containing between 10% and 110% by weight of tobacco extract; adding a small amount of a 95% glycerin—5% water by weight mixture to the web at the tongue of a rod maker; and forming the thus treated web into a shaped filter rod.

Accordingly, an object of the invention is to provide a method for producing an improved cigarette filter.

A further object of the invention is to provide a method for producing a cigarette filter having between 10% and 110% tobacco extract by weight of the filter material at commercially acceptable speeds.

A still further object of the invention is to provide a filter having between 10% and 110% tobacco extract by weight of the filter material which may be produced at commercially acceptable speeds.

DETAILED DESCRIPTION OF THE PREFERRED EMBODIMENT

In a preferred embodiment, the method of this invention comprises the following steps. First, a filter web is formed in accordance with Radwanski et al. U.S. patent application Ser. No. 003,980, filed Jan. 16, 1987, now U.S. Pat. No. 4,961,415 which is incorporated herein by reference. Next, the filter web is coated with a solution having a concentration by weight of between 10% and 40% solution of tobacco extract in water using a conventional dip and squeeze coater. Following this, the filter web is dried using standard drying equipment such as drying cans. This produces a filter web having by weight between 10% and 110% tobacco extract with a finished web moisture content of between 3% and 10%.

To complete the process, the thus treated filter web is formed into a rod by placing a roll of the thus treated filter web on a conventional rod maker, such as the KDF2 rod maker manufactured by Körber A. G., Hauni-Werke. Because a filter web containing high levels of tobacco extract will not run continuously at commercially acceptable speeds on a rod maker due to a build-up of tobacco extract on the tongue of the rodmaker, it is desirable to apply a lubricant, preferably glycerin or a water-glycerin mixture having by weight at least 95% glycerin, to the filter web at the tongue of the rodmaker, prior to entering the garniture section of a typical rod maker. The lubricant may be applied to the filter web by spraying or coating the lubricant onto the web.

When the manufacturing process is completed, the filter preferably meets the following specifications:

Dry tobacco extract content: between 10% and 110% by weight of the filter material.

Moisture content: between 3% and 10% by weight of the filter material

Rod Circumference: between 15 and 30 mm

Pressure drop: between 0.1 and 6.0 cm $H_2O$/cm of rod length

Rod firmness: between 0.3 and 1.2 mm deflection

Rod circumferences, pressure drop and rod firmness were determined using the techniques set forth in Radwanski et al. U.S. patent application Ser. No. 003,980, filed Jan. 16, 1987 . Now U.S. Pat. No. 4,961,415.

Figure 1:
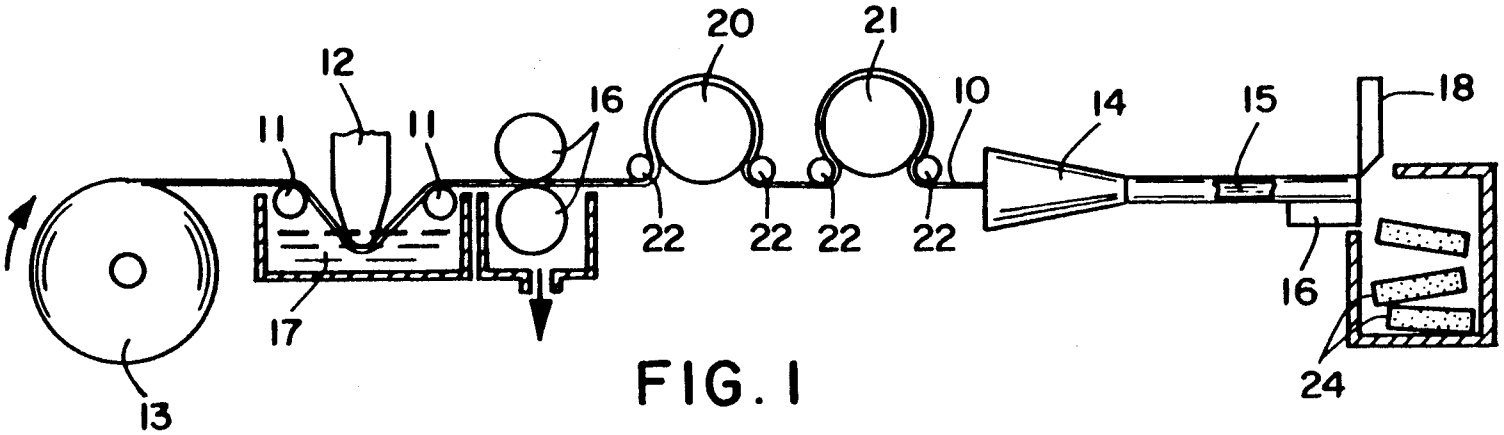
FIG. 1 illustrates the method for making a filter for smoking products in accordance with the invention.

Turning to the figures, FIG. 1 illustrates web material 13 being unwound and coated by means of a dip-and-squeeze coater which comprises guide rolls 11, guide roll 12, bath 17 and squeeze rolls 16. It is then passed over a series of one or more drying cans 20, 21 with wrap rolls 22, after which dry web 10 is formed by means of rod maker 14 into a rod 15 which may then receive a wrapping of paper web 16 and cut into desired lengths 24 using blade 18.

Figure 2:
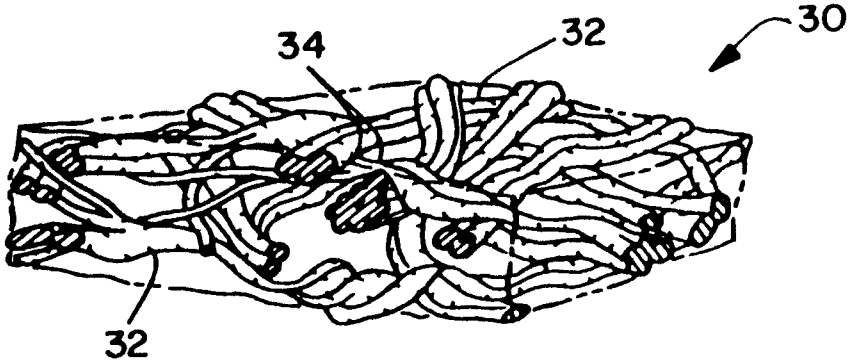
FIG. 2 (PRIOR ART)
FIG. 2 illustrates a preferred form of prior art web useful in the process and for the filter of the present invention.

FIG. 2 schematically illustrates in perspective a view of a prior art web useful in accordance with the present invention showing web 30, agglomerates 32, and bond crossover points 34.

As will be apparent to one skilled in the art, any type or combination of tobacco extracts may be used. As will also be apparent, other flavorants may be used alone or in combination with other flavorants.

The examples which appear below in this application are illustrations of actual cigarette filters produced by the method of this invention.

| Example | % Dry Tobacco Extract (by weight of filter material) | Rod Circumference (mm) | Pressure Drop ($cmH_2O$/cm rod length) | Rod Firmness (mm Deflection) |
|---|---|---|---|---|
| 1 | 50 | 23.9 | 2.8 | 0.65 |
| 2 | 32 | 23.9 | 2.7 | 0.51 |
| 3 | 24 | 24.2 | 3.3 | 0.49 |

During experimental development, a trial was run on a commercial coater to put tobacco extract on the polypropylene filter web. The trial showed that the web could be commercially coated with tobacco extract up to 110% dry solids add-on.

The foregoing description relates to certain embodiments of the present invention, and modifications or alternations may be made without departing from the spirit and scope of the invention as defined in the following claims.

We claim:

1. A method of making a filter for smoking products which comprises the steps of:

forming a filter web using a non-woven comprising thermoplastic meltblown fibers or filaments that are present as fused agglomerates in a number fraction exceeding 33 percent and wherein a majority of fiber crossings of agglomerates are weld points; and adding an aqueous solution of tobacco extract to the filter web in an amount such that the filter contains tobacco extract in an amount between 10% and 110% by weight of the filter material;

forming the thus treated filter web into a rod.

2. The method of claim 1, further comprising the step of adding a lubricant to the filter web prior to forming it into a rod.

3. The method of claim 2, wherein said lubricant comprises glycerin or a glycerin-water mixture.

4. A filter for use with smoking products made in accordance with the method of claim 3.

5. A filter for use with smoking products made in accordance with the method of claim 2.

6. A filter for use with smoking products made in accordance with the method of claim 1.

7. A method of making a filter for smoking products which comprises the steps of:

forming a filter web using non-woven web comprising thermoplastic meltblown fibers or filaments that are present as fused agglomerates in a number fraction exceeding 33 percent and wherein a majority of fiber crossings of agglomerates are weld points; and adding a 10% to 40% solution of tobacco extract in water to the filter web in a sufficient quantity such that the filter web when dried contains tobacco extracts in a quantity of between 10% and 110% tobacco extracts by weight of the filter web;

drying the thus treated filter web to form a filter rod, which contains between 10% and 110% tobacco extract by weight of the filter web;

adding 100% glycerin or at least a 95% glycerin—5% water by weight mixture to the thus treated web; and forming the thus treated web into a rod having a circumference of between 15 and 30 mm.

8. A filter for use with smoking products made in accordance with the method of claim 7.

* * * * *